US005622074A

United States Patent [19]

Cushman

[11] Patent Number: 5,622,074

[45] Date of Patent: Apr. 22, 1997

[54] SPLIT SIDEWINDER DRAW MACHINE ASSEMBLY

[75] Inventor: Floyd E. Cushman, Shelby Township, Mich.

[73] Assignee: MNP Corporation, Utica, Mich.

[21] Appl. No.: 489,389

[22] Filed: Jun. 12, 1995

[51] Int. Cl.[6] ..... B21C 1/02

[52] U.S. Cl. ..... 72/289; 242/470; 242/598.1; 242/598.2

[58] Field of Search ..... 242/598.1, 598.2, 242/470, 592, 399.2, 533, 533.2; 72/289

[56] References Cited

U.S. PATENT DOCUMENTS

| | | | |
|---|---|---|---|
| 810,606 | 1/1906 | Ball | 242/598.2 |
| 1,857,037 | 5/1932 | Bacon | 242/598.2 |
| 2,565,325 | 8/1951 | Rich | 242/533 |
| 2,733,017 | 1/1956 | Chrzanowski | 242/598.2 |
| 5,042,272 | 8/1991 | Furr | 242/533.2 |

FOREIGN PATENT DOCUMENTS

| | | | |
|---|---|---|---|
| 209353 | 8/1990 | Japan | 242/533.2 |
| 492327 | 11/1975 | U.S.S.R. | 72/289 |

*Primary Examiner*—Daniel C. Crane

*Attorney, Agent, or Firm*—Reising, Ethington, Barnard & Perry

[57] ABSTRACT

A sidewinder draw machine (16) has a capstan (20) that is selectively engageable with a frame (26) for rotation with the capstan (20). The frame (26) is mounted on a turntable which is rotatably mounted on a platform (30). The platform has a lower tier (34) mounted on a base (36) for pivotable motion between a horizontal and vertical position. The platform also has an upper tier (32) that is both pivotable and slidable with respect to the lower tier (34) such that the frame can be reoriented to provide ease in unloading a coil bundle (90) formed thereon.

19 Claims, 3 Drawing Sheets

SPLIT SIDEWINDER DRAW MACHINE ASSEMBLY

TECHNICAL FIELD

The field of this invention relates to wire and rod draw assemblies that recoil the rod into coil bundles.

BACKGROUND OF THE DISCLOSURE

Steel and other metals are often formed into rod stock and bundled into coils for transportation to processing sites that mass produce small metal articles such as nuts, bolts, screws, washers and a myriad of other small parts. The coils of rod often need to be drawn, re-sized, coated, rounded, or reshaped (i.e. converted into wire) before the wire is then cut into pieces where it is then forged, stamped or otherwise processed into a final article.

Consequently, the coils of rod are uncoiled in-line processed, and then recoiled after the desired in-line processing. The recoiling is most commonly done in two ways. One way is to have a draw capstan mounted for rotation about a vertical axis and a tubular frame mounted to and extending above the capstan for receiving the coils as they move from about the capstan. The plurality of coils can then be appropriately tied and unloaded from the tubular frame by lifting with an overhead crane or overhead conveyor.

A second way is by using a machine called a sidewinder draw machine that has a capstan rotatable about a horizontal axis and a frame affixed to the capstan and extending sideways therefrom. The coils after being formed on the capstan slide sideways onto the frame that rotates with the capstan. The coils then need to be compressed and strapped together. Because the stock can exceed one inch diameter and the diameter of a coil may exceed several feet, the manual labor used to compress the coils together and strap them into bundles is intensive and requires great exertion to pull and push the coils sideways on the frame due to the great weight of the coils.

A fork lift truck can then pick up the coils from the end of the frame. While a sidewinder provides advantages in eliminating the need for an overhead crane, the sidewinder requires much floor space to allow the fork lift to maneuver to the far distal end of the frame. Secondly, this floor space needed for the fork lift is remote from the floor space that is used by the fork lift to originally load the supply rod. The fork lift needs to be aligned near the axis of rotation of the capstan for picking up the coils as opposed to being laterally spaced from the axis of rotation for dropping off the supply coils. This requirement for two distinct spaces for the fork lift truck reduces the efficiency of the sidewinder. Furthermore, the manual labor needed to shift the coils is not needed in the other type of draw capstan.

Furthermore, turntable devices are often used to allow the continuous feeding of rod from supply coils to in-line processing lines. The turntable has a generally horizontal platform with an upwardly extending frame that rotates about a vertically oriented axis. The coils are mounted about the frame and as rod is drawn from the supply, the turntable is rotated. The turntable may be portable or stationary. Pivoting turntables have been developed to pivot the platform to a vertical direction to extend the frame horizontally in order to expedite the reception of coils directly from a fork lift.

What is needed is a recoiling system for rod and wire that provides for the efficiency of floor space of a vertical axis capstan recoiler but eliminates the need of a overhead crane or the need to lift the heavy coils over the frame. What is also needed is a recoiling system that incorporates a split sidewinder that includes a pivoting turntable that can receive coils from the capstan and be disengageable from the capstan and movable in multiple directions to allow ease in unloading of the coil bundles from the turntable.

SUMMARY OF THE DISCLOSURE

In accordance with one aspect of the invention, a recoiling system for stock rod includes an improved sidewinder draw machine that includes a capstan being rotatably mounted to a housing about a generally horizontal axis rotatable turntable having an elongated frame is selectively engageable and disengageable from the capstan. The capstan is constructed for winding rod about its peripheral surface which is tapered down to a distal end to form a plurality of coils of the stock rod that are directed onto the elongated frame of the turntable.

The frame has a distal end operably engageable with the capstan for rotation with the capstan about a generally horizontal axis. The rotatable frame is mounted on a turntable platform that can operably move the frame into and out of engagement with the capstan. The platform is preferably constructed to tilt the turntable when it is disengaged from the capstan such that its axis of rotation becomes generally vertically oriented and the formed coils of rod stock about the frame member is allowed to drop by gravity and compress onto said turntable.

The platform is also preferably constructed to further tilt the turntable when it is disengaged from the capstan such that the axis of rotation of the turntable becomes generally horizontal and greatly angled to the axis of rotation of the capstan in order for the formed coil bundle thereon to be removable in a generally horizontal direction along the axis of the elongated frame section. In one embodiment the axis of rotation of the turntable becomes horizontal and perpendicular to the axis of rotation of the capstan.

In one embodiment, the capstan has a radially extending wall that is positioned between a hub and an inner diameter surface of the peripheral wall of the capstan. The radially extending wall is engageable with a distal section of the elongated frame member to rotate the turntable and frame with the capstan. Preferably, there is a plurality of radially extending walls extending between a hub and an inner surface of the peripheral wall in the capstan to form a plurality of pockets in the capstan that receive rounded curved distal ends of a plurality of tubes that form the elongated frame. One section of each tube is abuttable against a first surface of one of the radially extending walls. A second section of the tube is on an opposite side of the rounded curved distal end and is abuttable against a second surface of an adjacent radially extending walls to rotate the turntable and frame with the capstan and to limit rotation of the turntable and frame with respect to the capstan.

In a preferred embodiment, the capstan has a frame adapter mounted thereon which extends axially from the capstan and is drivingly engageable to the rotatable frame.

In accordance with another aspect of the invention, a turntable assembly for receiving coils of rod thereon includes a rotatable turntable. The turntable has an elongated frame section with a distal end operably engageable with a rotatably driven capstan for rotation with the capstan about a generally first horizontal axis. The rotatable turntable is mounted on a platform that axially slides between two axial positions such that the distal end of the frame is either in or out of engagement with the capstan. The platform is also constructed to tilt the turntable when it is out of engagement with the capstan about two horizontal and substantially horizontal axles. The axies in one embodiment are substantially perpendicular.

The elongated frame in one embodiment includes a plurality of tubular sections having a rounded curved distal end. The rounded curved distal end is connected to two longitudinally extending tubular sections that are both radially and circumferentially spaced from each other.

In a preferred embodiment, the frame includes a plurality of rods having a distal end mounted to a distal plate. The plate has peripheral recesses to provide a cavity for the prong of a fork lift truck and a plurality of interconnections with the frame adaptor on the capstan such that it rotates with the capstan.

In one embodiment, the platform includes a stationary base member and a lower tier section that is pivotally mounted with respect to the base between a horizontal position and a vertical position along a first horizontal pivot axis. An upper tier section is mounted on the lower tier section and rotatably mounts the turntable. The upper tier section is pivotally mounted with respect to said lower tier section and pivots between a horizontal position and a vertical position along a second horizontal pivotal axis when the lower tier is in its horizontal position. The second horizontal pivotal axis is preferably substantially perpendicular to the first horizontal pivotal axis.

In addition, the upper tier section is constructed to slide between the two axial positions with respect to the lower tier. This slide motion preferably is achieved by having the upper tier section connected to an end of a slide that is slidably received in a channel that is mounted on the lower tier section. The slide is movable in the channel by a hydraulic piston and cylinder assembly that is mounted in the channel.

Preferably, the upper and lower tier sections are powered and movable between the respective horizontal and vertical positions by additional operably connected hydraulic piston and cylinder assemblies mounted between the base and lower tier and lower tier and upper tier.

BRIEF DESCRIPTION OF THE DRAWINGS

Reference now is made to the accompanying drawings in which.

DETAILED DESCRIPTION OF THE PREFERRED EMBODIMENT

Figure 1:
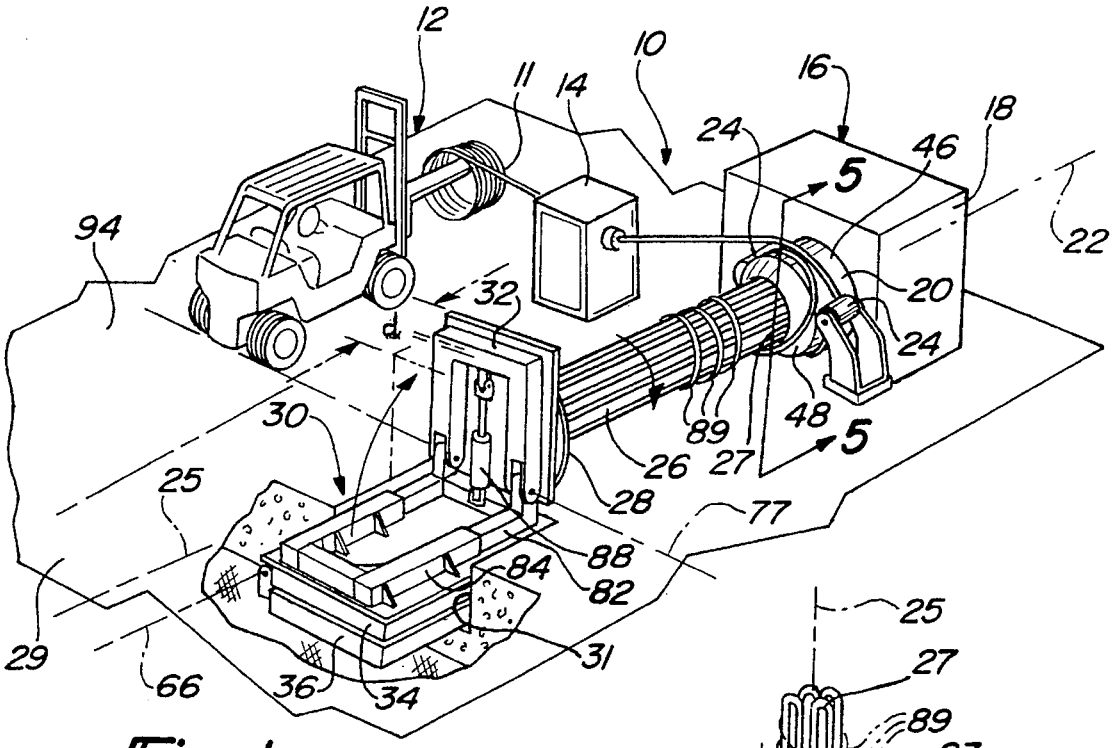
FIG. 1 is a perspective of an embodiment in accordance with the invention.

Referring now to FIG. 1, an in-line processing assembly generally indicated as 10 for stock rod 11 includes a rod supply station 12 and a processing unit 14. The supply station 12 may be a fork lift truck as shown or a commercially available turntable. The processing unit 14 may be to round the rod into wire, to downsize the rod, to reshape the rod or apply some other type of process onto the rod. The specific process is not part of the present invention other than the fact that the rod 11 is usually being processed in some fashion which requires it to be uncoiled and drawn through the processing unit 14 and then recoiled.

A sidewinder draw assembly 16 includes a housing 18 that mounts a capstan 20 for rotatable motion about horizontal axis 22 that with its associated rollers 24 is used to draw the rod 11 from its supply station 12 located in front of the sidewinder draw assembly 16 and through the processing unit 14. The housing 18 contains a motor and gearing (not shown) that rotatably drives the capstan 20 in a conventional manner.

The capstan 20 is also used to recoil the processed rod 11 onto an elongated frame 26 that has its distal end 27 is rotatably engaged with the capstan 20. The frame 26 is mounted to a turntable 28 that is rotatably mounted onto a platform 30 about an axis 25 that is presently aligned with axis 22 as shown in FIG. 1. In general, the platform 30 has an upper tier 32 that mounts the turntable. The upper tier 32 is slidably and pivotably mounted onto a lower tier 34. The lower tier 34 is pivotably mounted onto a base 36. As shown, base 36 is received and affixedly secured in a pit 31 in floor 29. However, other arrangements are possible; for example, the base 36 may rest and be secured on the floor 29 and a taller housing 18 may rotatably mount capstan 20 at a higher location.

Figure 2:
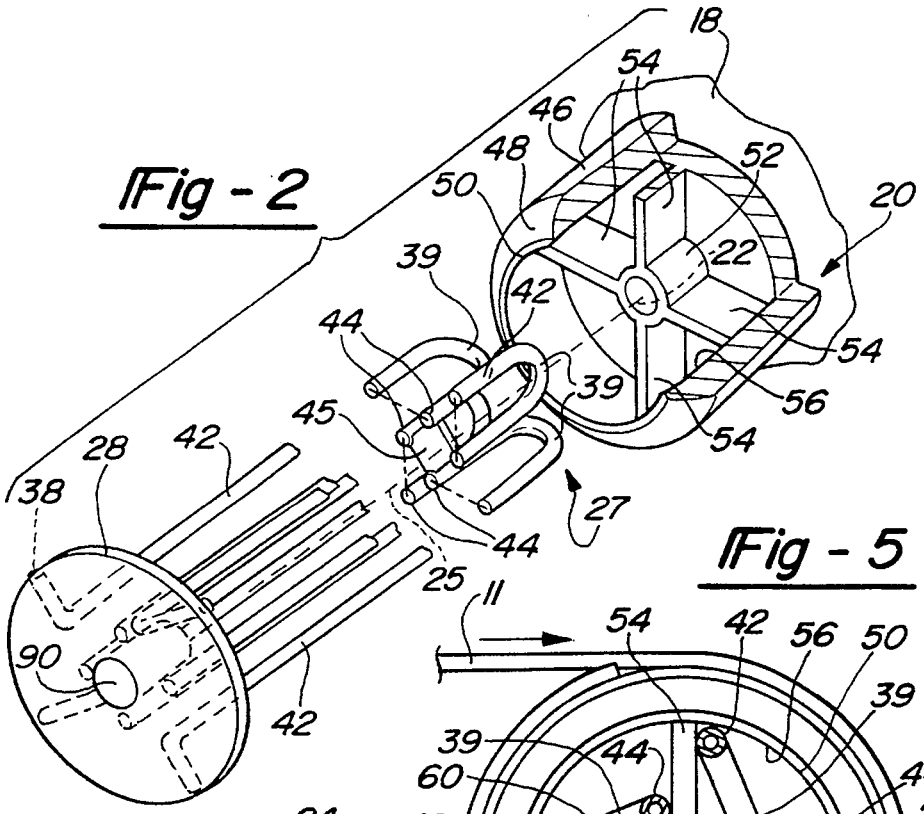
FIG. 2 is an enlarged fragmented and partially sectional view showing the frame disengaged from the capstan.

In particular and as clearly shown in FIG. 2, capstan 20 has a peripheral tapered frusto-conical wall 46 and a distal nose cone section 48 that has an increased taper with respect to wall section 46. The taper of the wall 46 may be a slight 4°–5° and the nose cone section 48 may have a taper of approximately 30° from the axis of rotation 22. The peripheral wall 46 and nose cone 48 have an inner diameter surface 56 to form an open end 50 sized to receive the distal end 27 of the frame. Accessible through the open end is a hub section 52 and four drive ribs or spokes 54 that extend from the hub to the inner diameter surface 56 of capstan 20 that forms four quadrants or pockets 58.

Figure 5:
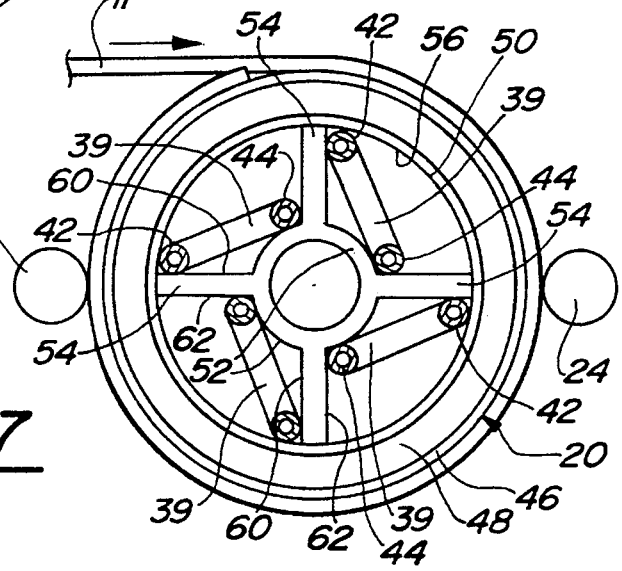
FIG. 5 is a cross-sectional view taken along lines 6—6 shown in FIG. 1.

As clearly shown in FIG. 5, the pockets 58 are sized to receive a respective distal end 27 of the frame. The distal end 27 includes four rounded tube sections 39 that connect two longitudinally extending tube sections 42 and 44 that are both radially and circumferentially spaced from each other. These tube sections 42 are spaced such that tube 42 abuts against a radially outer section of surface 60 of rib walls 54 near the inner diameter surface 56 and tube section 44 abuts against the hub 52 and a radially inner section of an opposite surface 62 of the rib 54. The rounded tube section 39 helps guide the frame into the pockets 58 if there is a misalignment between the capstan 20 and the frame 26. The position of tube sections 44 maintain a close axial alignment of the frame 26 with the capstan 20. The inner tubes 42 may be secured together by being welded to a central plate 45 positioned near the distal end 27.

Figure 7:
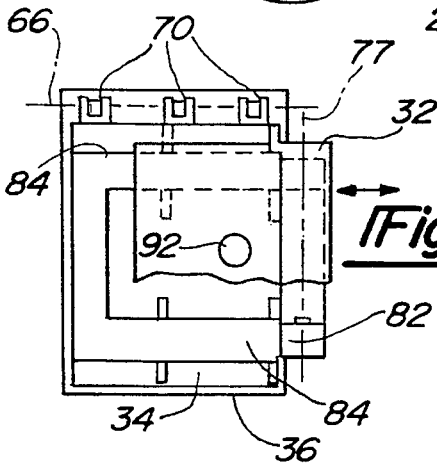
FIG. 7 is a top plan view of the platform for the turntable.

The frame 26 also includes a radially outwardly extending base section 38 that is welded to the turntable 28. The turntable has a hub section 90 mounted on a spindle 92 shown in FIG. 7 that is affixed on upper tier section 32 for providing securement and rotation of the turntable on the upper tier 32.

The platform 30 that pivotably and rotatably mounts the frame 26 has its lower tier 34 mounted on base 36 for pivotable movement about horizontal pivot axis 66 that is substantially parallel to axis 22. This pivot axis can be formed by appropriate pins 70 and apertures 72. The lower tier 34 is operable between a horizontal position shown in FIG. 3 and a vertical position shown in FIG. 4 by a hydraulic cylinder and piston assembly 68 that operably connects the lower tier 34 with the base member 36.

Figure 3:
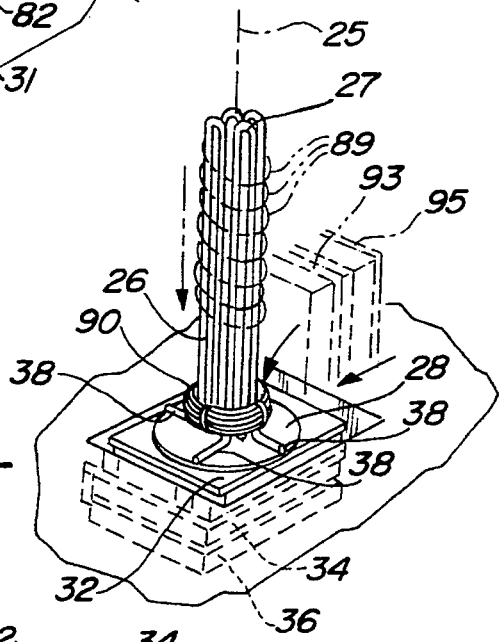
FIG. 3 is a perspective view of the turntable with the frame pivoted to a vertical position.
Figure 6:
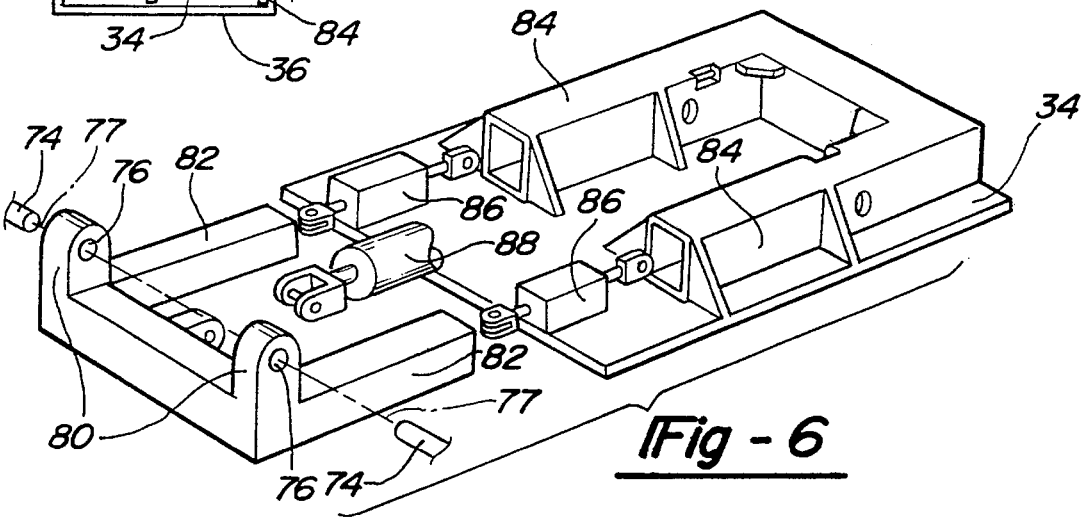
FIG. 6 is an exploded view showing of the slide mechanism and channels of the platform.
Figure 8:
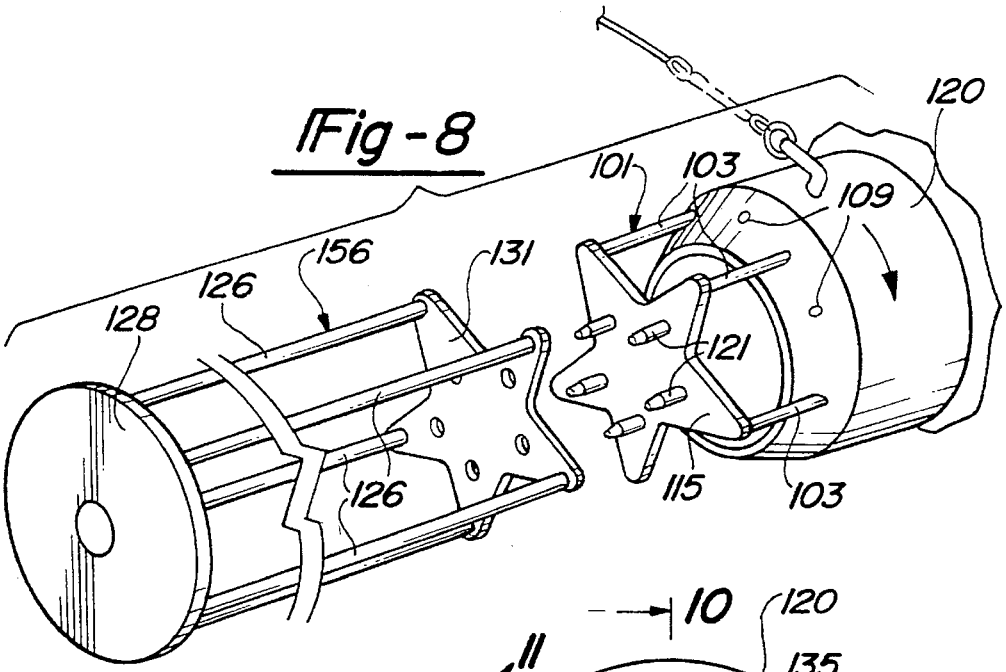
FIG. 8 is a view similar to FIG. 2 showing an alternate embodiment.

The upper tier 32 is pivotably connected to the lower tier 34 for pivotable motion between a horizontal position as shown in FIG. 3 and a vertical position shown in FIG. 1 about pivot axis 77. Pivot axis 66 is perpendicular to pivot axis 77 as clearly shown in FIG. 7. The upper tier pivot axis 77 is appropriately formed by pins 74 and apertures 76. The apertures 76 may be formed in an upper flange 80 on a slide 82 that is housed in a channel 84 on lower tier 34 as shown in FIG. 6. The pivoting motion of the tier 32 may be actuated by a cylinder and piston assembly 88 that is operably connected between the upper tier 32 and slide 82. Cylinder and piston assemblies 88 may be operably installed in channels 84 to slide the upper tier 32 translationally with respect to the lower tier 34 between positions 93 and 95 indicated in FIG. 3.

Each piston and cylinder assembly 68, 86, and 88 may be hydraulically driven. The hydraulic source may controlled by remote manual switches (not shown) or be automated by an electronic control panel that has various inputs to determine the best times to actuate the piston and cylinders assemblies. This control aspect forms no part of the invention in that the invention may be driven by simple manually operated actuation devices.

In operation, the elongated frame 26 is positioned as shown in FIG. 1 where the frame is drivingly engaged with the capstan 20. The capstan draws the rod 12 through the processing unit 14 and then winds the rod about capstan wall 46. The taper of the wall 46 and the nose cone end 48 provides that the rod 11 as it coils about the capstan eventually works its way onto the frame 26. The frame tubes 44 are positioned just inside the inner diameter surface 56 a distance less than the diameter of the rod 11 such that the rod is unable to wedge itself between the frame 26 and capstan 20. Furthermore, the positioning of the tubes 42 and 44 in pockets 58 limits the amount of backlash of the frame 26 and turntable 28 with respect to the capstan. The capstan wall surface 60 smoothly drives the frame 26 and turntable during the drawing of the rod 11.

When the processing of the rod 11 is completed, or a desired amount of rod is coiled about frame 26, the draw capstan 20 can be stopped and the rod 11 can be cut. The upper tier 32 is then slidably moved from position 95 to position 93 to disengage the frame 26 from the capstan 20 as shown in FIG. 2. At this point the coils of rod are loosely spaced about the frame as loose coils 89.

The upper tier 32 is then pivoted from position 93 to a horizontal position as shown in FIG. 3 such that the axis of rotation 25 of the frame points upwardly and the coils 89 are free to fall against the base 38 of frame 26 to achieve a compressed state. The coils are compressed together merely by gravity and need no pulling or other manual assistance. The coils then can be appropriately tied or strapped together into a coil bundle 90 as shown in FIG. 3.

Figure 4:
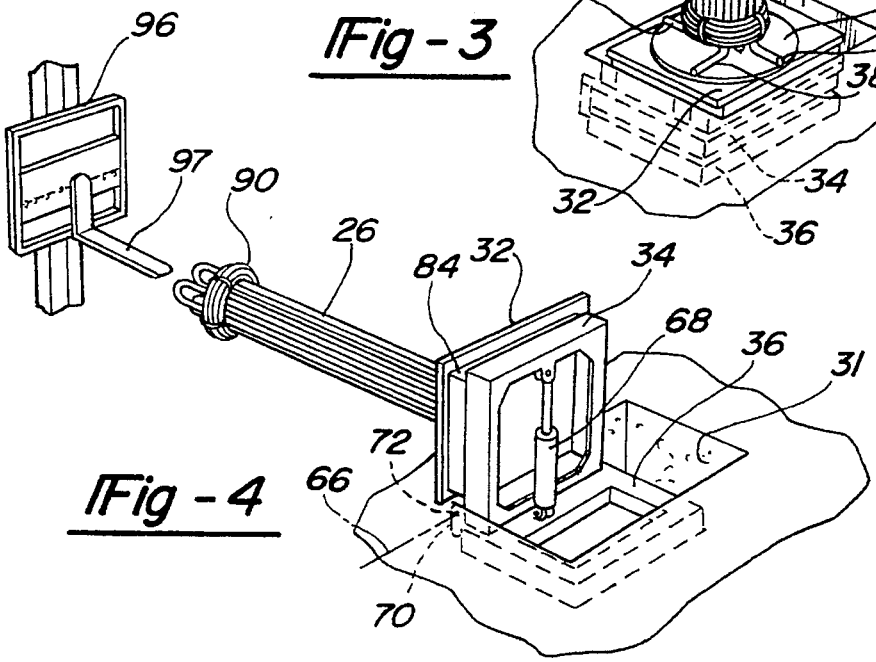
FIG. 4 is view similar to FIG. 3 with the turntable tilted to orient the turntable such that its axis of rotation is horizontal and perpendicular to the axis of rotation of the capstan for allowing transport for the bundled coil.

The platform lower tier 34 is then pivoted to a vertical position as shown in FIG. 4 such that the axis 25 of the frame extends forward and perpendicular to the rotational axis 22 of the capstan. At this point, the coil bundle 90 can be lifted and transported by a fork lift 96 that can have a fork tine 97 pass through the open space between tubes 42 radially outside of plate 45 in frame 26 and engage and lift and pull the bundle 90 off the frame 26. The access to the bundle is from the front of the sidewinder draw machine 16 adjacent to where the supply 12 of rod as indicated by area 94 shown in FIG. 2 such that the fork lift does not need to maneuver directly along the axis 22 of capstan 20 at the side of the sidewinder draw assembly 16. Furthermore, the space 94 is adjacent the supply station 12 and the fork lift may easily travel between the two adjacent areas.

After the coil bundle 90 is removed, the platform then can have the lower tier 34 repositioned to its horizontal position and the top tier pivoted to its vertical position as shown in FIG. 2. The upper tier can then slide from position 93 to position 95 to reengage the frame 26 with the capstan 20 to receive another supply of rod 11 from capstan 20.

An alternate embodiment of the frame 126 and its connection to a capstan 120 is illustrated in FIGS. 8–12. The capstan 120 has an adapter 101 mounted to the nose cone section 148 via threaded rods 103 threaded into complementary threaded apertures 105 therein. The nose cone 148 is mounted to the capstan 120 in a similar fashion as with the first described embodiment by using threaded bolts 107 passing through stepped apertures 109 through the nose cone and engaging threaded holes 111 in capstan 120.

The distal ends of rods 103 are connected to a drive plate 115 via bolts 117 that thread into the ends 119 of rods 103. The drive plate 115 also has a plurality of bullet shaped drive protrusions 121 that have a threaded back end 123 that receives a nut 125 to secure the drive protrusions 121 protruding through apertures 121 in plate 121 onto plate 115.

Figure 10:
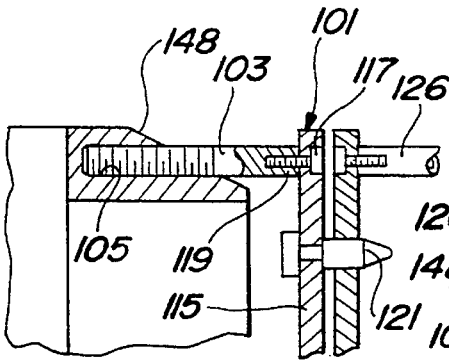
FIG. 10 is a cross-sectional view taken along lines 10—10 shown in FIG. 9.
Figure 9:
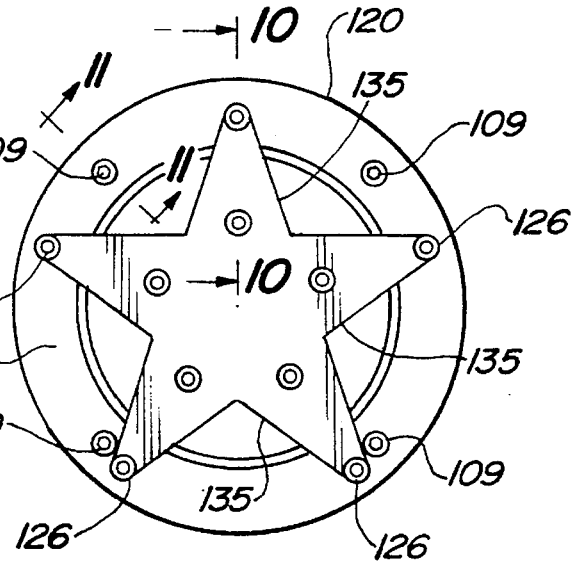
FIG. 9 is side elevational view of the capstan assembly shown in FIG. 8.
Figure 11:
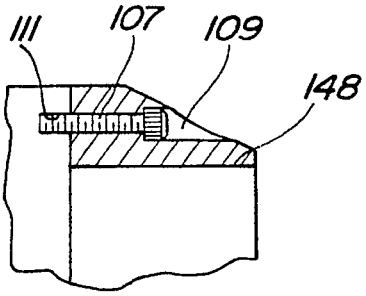
FIG. 11 is a cross-sectional view taken along lines 11—11 shown in FIG. 9.
Figure 12:
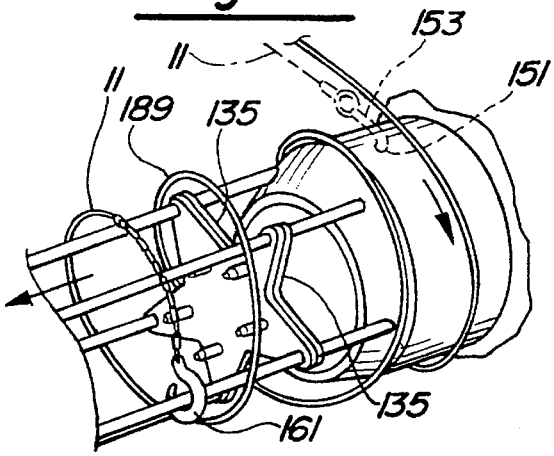
FIG. 12 is a fragmentary perspective view showing the wire being coiled about the capstan and frame.

The frame 156 includes a driven plate 131 that is secured to rods 126 in a similar fashion as plate 115 is secured to rods 103. The plate 131 also includes apertures 133 sized and positioned to receive the protrusion 121 as shown in FIGS. 10 and 12. The rods are aligned with rods 126 when the two plates 115 and 131 are interconnected.

The drive plates are both star shaped such that it has recesses 135. The other end of each rod 126 is welded onto rotatable turntable 128. The turntable is mounted to the same platform 30 as shown for the first embodiment.

The drawn rod 11 is at first drawn by capstan via hook 153 that mounts into the capstan 120 through an aperture 151 that is clamped onto the end of the rod 11. After the rod 11 is coiled about the capstan 120 a few times, the hook is removed and another hook 161 is mounted about one of the frame rods 126. The rollers 24 are then moved into position to retain several coils about the capstan 120 while the lock 161 draws the formed coils about the frame 156. The coils 189 slidably push the hook 161 toward the turntable 128.

Once the desired number of coils 189 are formed, the frame 156 is disconnected from the adapter 101 and moved in the same fashion upward and then horizontal by platform 30 as previously described.

The second embodiment provides for a frame that has an effective diameter that is closer to the outer diameter of capstan 120. Furthermore, the stresses occur in the adapter 101 which, if it breaks, can be easily replaced. This adapter thus saves wear and tear on the drive hub 22 and side walls 54 of the capstan.

The second embodiment also provides for a shorter frame 156 because their is no need for the rods 126 to extend into the hub of capstan 120 to engage the hub 20 and side walls 54. The shorter frame 156 provides for less torque and better control of the motion by platform 30.

In this fashion, a sidewinder draw machine by splitting apart can be used to recoil the rod without the need for manually compressing the coils nor using an overhead conveyor or crane to lift the coils from a vertical oriented frame. Furthermore, the reorientation of the finished coil bundle 90 for transport with a fork lift reduces the floor space needed for the supply and processing of the rod 12 and the subsequent removal of the finished coil bundle 90 thereby greatly increasing the efficiency of the machine.

Variations and modifications are possible without departing from the scope and spirit of the present invention as defined by the appended claims.

The embodiments in which an exclusive property or privilege is claimed are defined as follows:

1. A draw and recoiling system for a supply of rod, said system characterized by;

a capstan being rotatably mounted to a housing about a generally horizontal axis and having a tapered peripheral surface tapered down to a distal end, said capstan constructed for receiving rod about its peripheral surface and winding said rod about said surface to form a plurality of coils of said rod;

said capstan having at least one drive element accessible at said distal end;

a rotatable turntable having an elongated frame section that has a distal end engageable with said capstan and operably and selectively engageable with said at least one drive element at said distal end of said capstan for rotation with said capstan about a generally horizontal axis;

said rotatable turntable being mounted on a platform that may axially slide said distal end of said frame into and out of engagement with said capstan, said platform also constructed to tilt said turntable when said turntable is out of engagement with said capstan such that the axis of rotation of the turntable becomes generally vertically oriented and said coils about said frame member are allowed to drop by gravity onto said turntable; and said platform also being constructed to tilt said turntable when said turntable is out of engagement with said capstan such that the axis of rotation of said turntable becomes generally horizontal and angled with respect to the axis of rotation of said capstan in order for said coil thereon to be removable in a generally horizontal direction along the axis of the elongated frame section.

2. A draw and recoiling system as defined in claim 1 further characterized by:

said drive element being a radially extending wall affixed on said capstan and being positioned between a hub and an inner surface of said peripheral wall in said capstan;

said radially extending wall engageable with a distal section of said elongated frame member to rotate said turntable and frame with said capstan.

3. A draw and recoiling system as defined in claim 2 further characterized by:

said drive element being a plurality of radially extending walls being positioned between a hub and an inner diameter surface of said peripheral wall in said capstan forming a plurality of pockets in said capstan;

said elongated frame including a plurality of tubular members having a rounded curved distal end that is receivable in said pocket with one section of said tube abuttable against a first surface of one of said radially extending walls and a second section of said tube on an opposite side of said rounded curved distal end abuttable against a second surface of another of said radially extending walls to rotate said turntable and frame with said capstan and to limit rotation of said turntable and frame with respect to said capstan when said frame is engaged to said capstan.

4. A draw and recoiling system as defined in claim 1 further characterized by:

said drive element being an adapter affixed on said capstan and axially extending beyond said tapered end of said capstan;

said adapter drivingly engageable with a distal section of said elongated frame member to rotate said turntable and frame with said capstan.

5. A draw and recoiling system as defined in claim 2 further characterized by:

said adaptor including a drive plate being constructed to be interconnected to a driven plate mounted on a distal end of said elongated frame.

6. A draw and recoiling system as defined in claim 1 further characterized by:

said platform also constructed to tilt said turntable when it is out of engagement with said capstan such that its axis of rotation becomes generally vertically oriented and said coils about said frame member allowed to drop by gravity onto said turntable.

7. A draw and recoiling system as defined in claim 6 further characterized by:

said platform being constructed to tilt said turntable when it is out of engagement with said capstan such that the axis of rotation of said turntable becomes generally horizontal and perpendicular to said first horizontal axis of rotation.

8. A turntable assembly for a draw and recoiling system; said turntable characterized by:

a rotatable turntable having an elongated frame section that has a distal end constructed to be operably engageable with a rotatably driven capstan for rotation with said capstan about a generally first horizontal axis;

said rotatable turntable being mounted on a platform that axially slides between two axial positions such that said distal end of said frame is either in or out of engagement with said capstan, said platform also constructed to tilt said turntable when it is out of engagement with said capstan such that its axis of rotation becomes generally vertically oriented and said coils about said frame member allowed to drop by gravity onto said turntable;

said platform being constructed to tilt said turntable when it is out of engagement with said capstan such that the axis of rotation of said turntable becomes generally horizontal and angled to said first horizontal axis of rotation in order for said coil thereon to be removable in a generally horizontal direction along the axis of the elongated frame section.

9. A turntable assembly as defined in claim 8 further characterized by:

said elongated frame including a plurality of tubular sections having a rounded curved distal end.

10. A turntable assembly as defined in claim 9 further characterized by:

said rounded curved distal end being connected to two longitudinally extending tubular sections that are both radially and circumferentially spaced from each other.

11. A turntable assembly as defined in claim 8 further characterized by:

said frame including a plurality of axially extending members with distal ends connected to a driven plate member; and said driven plate member has at least one recess at its periphery.

12. A turntable assembly as defined in claim 8 further characterized by:

said platform including a stationary base member and a lower tier section that is pivotally mounted on and with respect to said base between a horizontal position and a vertical position along a first horizontal pivot axis;

said platform including an upper tier section that is mounted on said lower tier section and rotatably mounts said turntable, said upper tier section is pivotally mounted with respect to said lower tier section and pivots between a horizontal position and a vertical position along a second horizontal pivotal axis when said lower tier section is in said horizontal position; and said second horizontal pivotal axis being substantially angled to said first horizontal axis.

13. A turntable assembly as defined in claim 12 further characterized by:

said upper tier section constructed to slide between said two axial positions with respect to said lower tier section.

14. A turntable assembly as defined in claim 12 further characterized by:

said upper tier section being pivotably connected to an end of a slide that is slidably received in a channel that is mounted on said lower tier section.

15. A turntable assembly as defined in claim 14 further characterized by:

said slide being movable in said channel by a hydraulic piston and cylinder assembly that is mounted in said channel;

said upper and lower tier sections being movable between the respective horizontal and vertical positions by operably connected hydraulic piston and cylinder assembly.

16. A turntable assembly as defined in claim 12 further characterized by:

said second horizontal pivotal axis being substantially perpendicular to said first horizontal axis such that said axis of rotation of said turntable become generally horizontal and perpendicular to said first horizontal axis.

17. A turntable assembly as defined in claim 8 further characterized by:

said axis of rotation of said turntable becomes generally horizontal and perpendicular to said first horizontal axis of rotation.

18. A draw and recoiling system for rod characterized by;

a capstan being rotatably mounted to a housing about a generally horizontal axis and having a peripheral surface extending to a distal end, said capstan constructed for receiving rod about its peripheral surface and wrapping said rod about said surface to form a plurality of coils of said rod;

said capstan having at least one drive member accessible at said distal end;

a rotatable turntable having an elongated frame section that has a distal end engageable with said capstan and operably engageable with said at least one drive member at said distal end of said capstan for rotation with said capstan about said generally horizontal axis and sized to axially receive said rod from about capstan as it axially slides off said distal end of said capstan as said capstan and said elongated frame section rotate;

said rotatable turntable being mounted on a platform that is operably constructed to move said distal end of said frame into and out of engagement with said capstan from a first position and reorient and adjust the position of said turntable to a second position along both an angular and longitudinal direction when it is disengaged from said capstan.

19. A draw and recoiling system as defined in claim 14 further characterized by:

said platform being constructed to reorient said turntable such that the axis of rotation of said turntable becomes generally horizontal and perpendicular to the axis of rotation of said capstan in order for said coil thereon to be removable in a generally horizontal direction along the axis of the elongated frame section.

* * * * *